US005535972A

United States Patent [19]

Fallago

[11] Patent Number: 5,535,972

[45] Date of Patent: Jul. 16, 1996

[54] ADAPTER FOR ADJUSTABLE SHELVING SYSTEM

[76] Inventor: Richard P. Fallago, 81 Mapleville Rd., Greenville, R.I. 02828

[21] Appl. No.: 365,577

[22] Filed: Dec. 28, 1994

[51] Int. Cl.[6] ..... A47B 96/06

[52] U.S. Cl. ..... 248/220.22; 248/221.11; 248/222.14; 248/243; 248/245

[58] Field of Search ..... 248/222.1, 243, 248/244, 245, 250, 231.4, 220.22, 221.11, 222.14; 211/192, 193, 190, 187; 108/108, 110, 144

[56] References Cited

U.S. PATENT DOCUMENTS

| | | | |
|---|---|---|---|
| 2,531,925 | 11/1950 | Taylor et al. | 248/243 X |
| 2,749,073 | 6/1956 | Guysi et al. | 248/231.4 |
| 3,054,511 | 9/1962 | Erismann | 108/108 |
| 3,353,684 | 11/1967 | Chesley | 211/187 |
| 4,466,596 | 8/1984 | Cohen | 248/231.4 X |
| 4,515,494 | 5/1985 | Robilliard et al. | 248/243 X |
| 4,671,481 | 6/1987 | Beard | 248/222.1 |
| 4,684,094 | 8/1987 | Everett | 248/222.1 X |
| 4,881,471 | 11/1989 | Schwartz et al. | 248/244 X |
| 5,230,492 | 7/1993 | Zwart et al. | 248/222.1 |

*Primary Examiner*—Alvin C. Chin-Shue
*Assistant Examiner*—Korie H. Chan
*Attorney, Agent, or Firm*—Salter & Michaelson

[57] ABSTRACT

An adapter releasably attaches to an existing wall-mounted shelf standard to provide a desired slot configuration for new shelf supports. The adapter includes a body portion having a fixed, rearwardly extending jaw member and further includes a movable rearwardly extending jaw member mounted on a threaded post which extends through the body portion. The jaws are received into the slots of an existing shelf standard and the post is rotatable to draw the movable jaw toward the fixed jaw to grasp the front wall of the shelf standard. The body portion includes a slotted front surface facing having the desired slot configuration for receiving the mounting tabs of a new shelf support.

1 Claim, 3 Drawing Sheets

ADAPTER FOR ADJUSTABLE SHELVING SYSTEM

BACKGROUND AND SUMMARY OF THE INVENTION

The instant invention relates to adjustable shelving systems and more particularly to an adapter for providing a desired slot configuration on an existing wall-mounted shelf standard.

Adjustable shelving systems typically include a plurality of slotted shelf standards, or rails, which are mounted to a wall. Shelf supports with corresponding mounting tabs are mountable in the slots of the shelf standards at various heights to provide flexibility in shelving arrangements. In this regard, a variety of different manufacturers supply slotted shelf standards and shelf supports having different slot sizes and spacing configurations. In most cases, one manufacturer's shelf standards are not interchangeable with another manufacturer's shelf supports, and vice versa. Each type of shelf standard thus requires its own corresponding shelf supports having mounting tabs with the corresponding size and spacing.

In this regard, due to the rapid turnover of merchandise, retail stores are periodically required to switch from one display system to another. When a retailer switches from one display system to another, the wall-mounted shelf standards must be replaced to accommodate new shelf supports. It has been found that frequent replacement of wall-mounted shelf standards is both time consuming and expensive.

The instant invention provides an adapter which releasably attaches to an existing wall-mounted shelf standard and provides the desired slot dimension and slot spacing for new shelf supports. The adapter comprises a body portion having a fixed, rearwardly extending jaw member and further comprises a movable rearwardly extending jaw member mounted on a threaded post which extends through the body portion. The jaws are received into the existing slots in the existing shelf standard and the post is rotated to draw the movable jaw toward the fixed jaw to grasp the existing shelf standard. The body portion includes a slotted front wall having the desired slot dimensions and slot spacings for receiving the mounting tabs of a different shelf support.

Accordingly, among the several objects of the invention are: the provision of an adjustable grasping mechanism for grasping varying size slots of existing shelf standards; and the provision of an adapter which releasably attaches to an existing shelf standard for providing desired slot sizes and spacings for new shelf supports.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
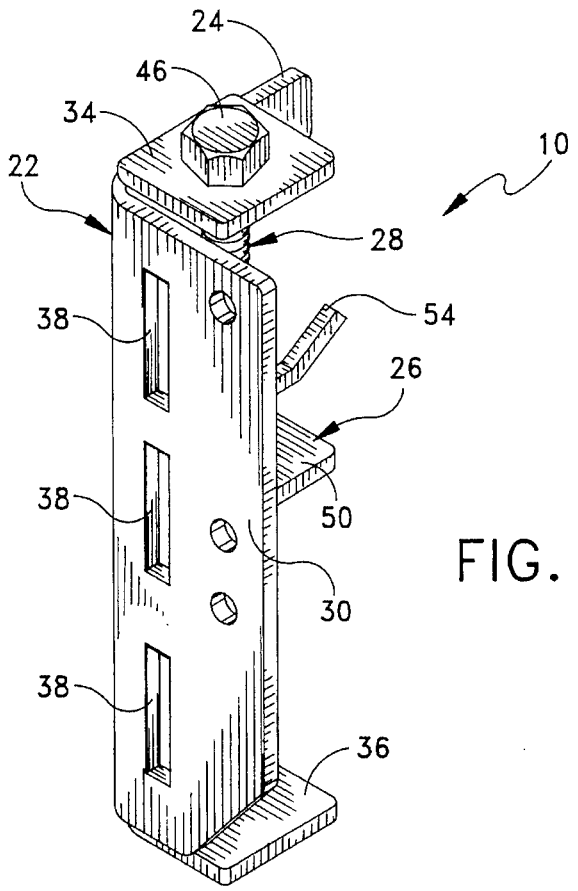
FIG. 1 is a front perspective view of the adjustable adapter of the instant invention.
Figure 2:
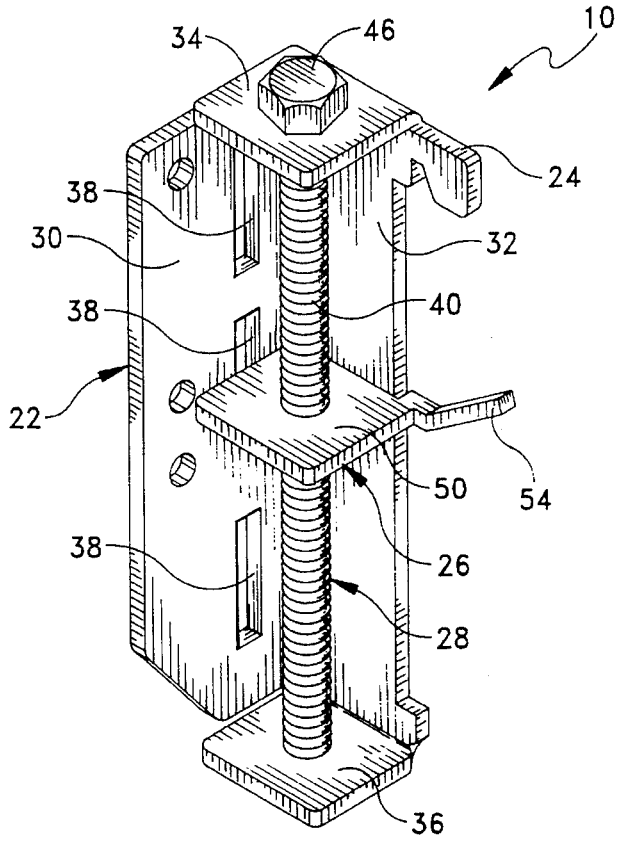
FIG. 2 is a rear perspective view thereof.
Figure 3:
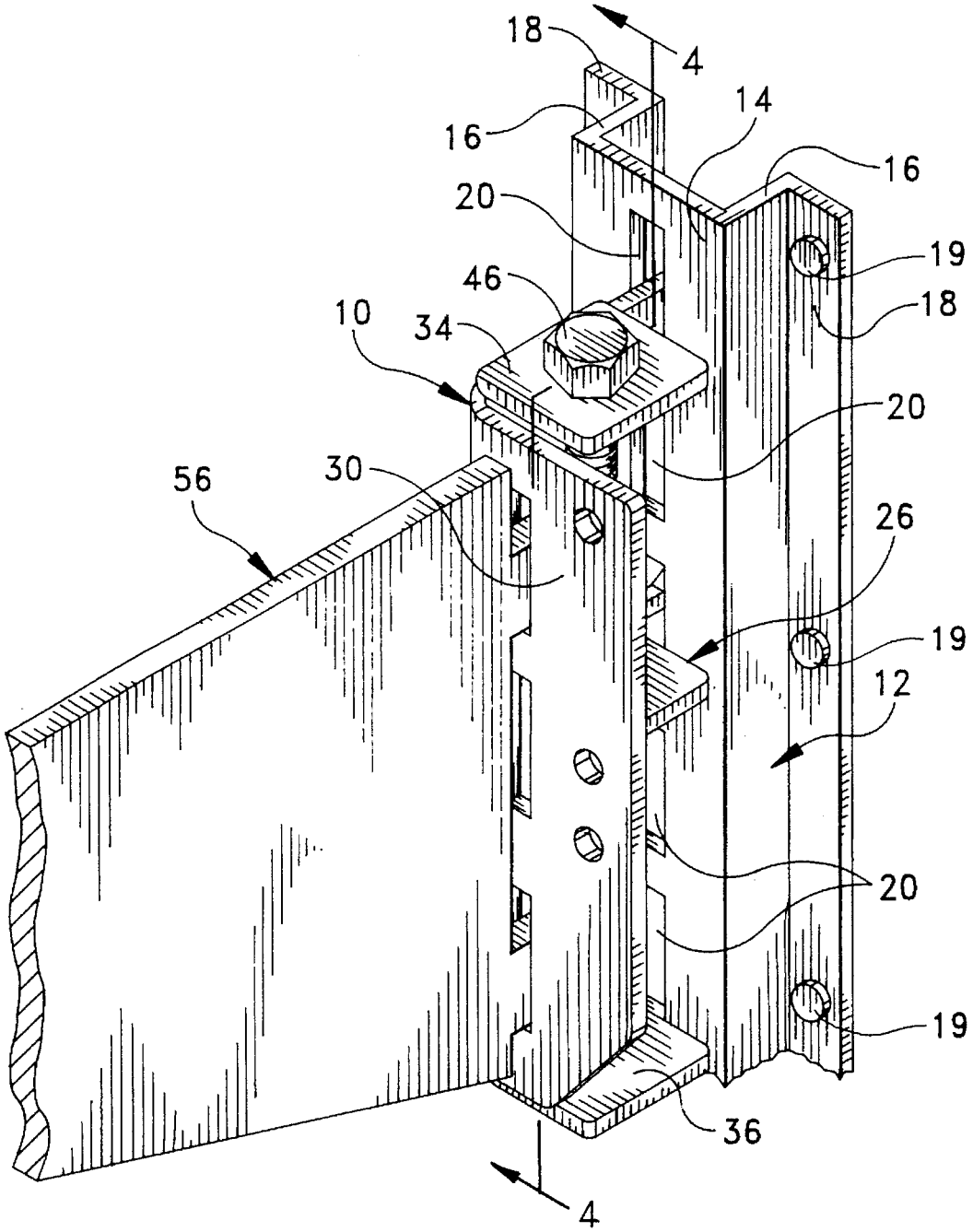
FIG. 3 is another perspective view thereof with the adapter secured on a shelf standard and a shelf support mounted on the adapter.
Figure 4:
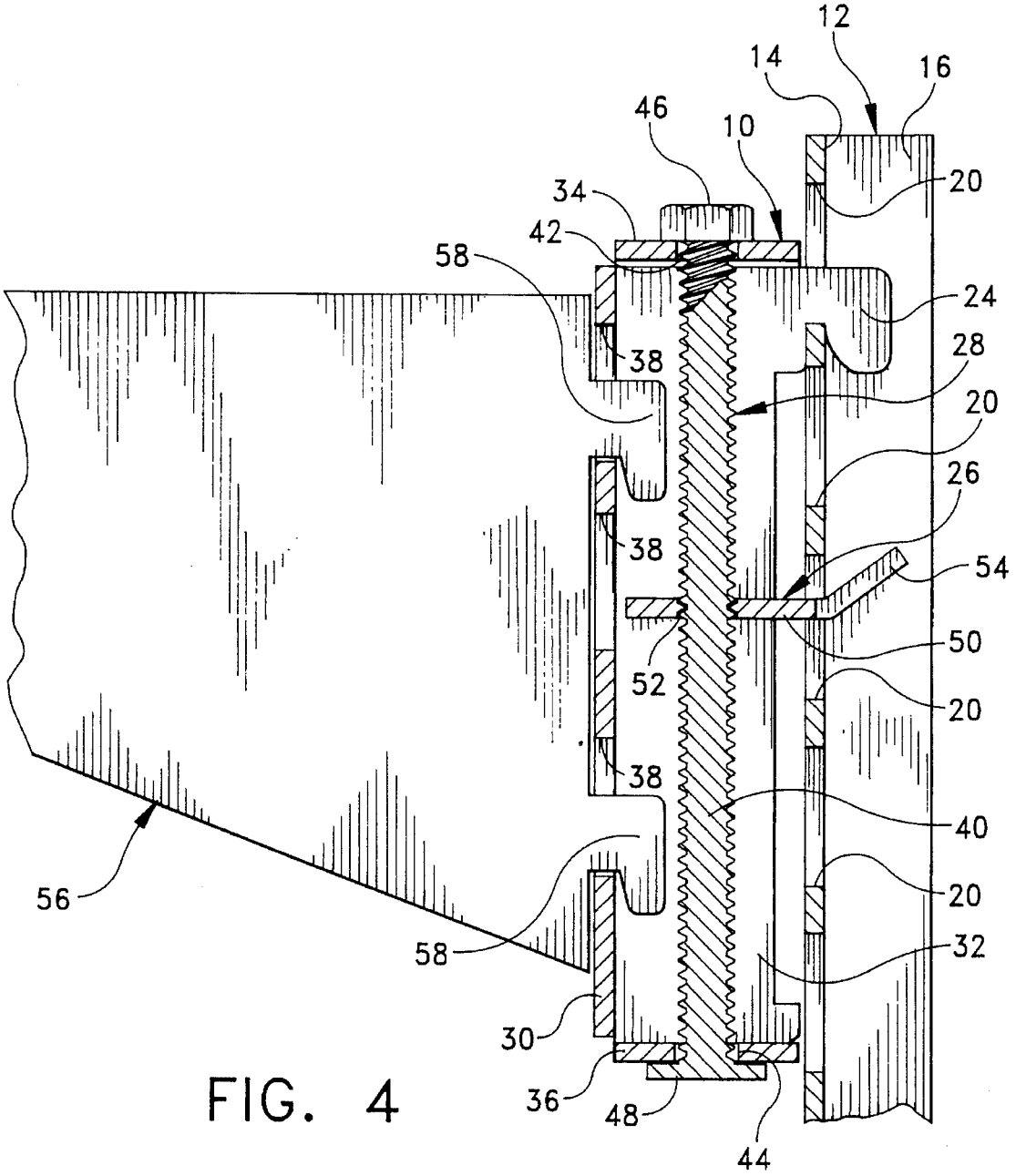
FIG. 4 is an enlarged cross-sectional view thereof taken along line 4—4 of FIG. 3.

Referring now to the drawings, the adapter of the instant invention is illustrated and generally indicated at 10 in FIGS. 1 through 4. As will hereinafter be more fully described, the instant adapter releasably attaches to an existing shelf standard generally indicated at 12 for providing desired slot sizes and slot spacings for new shelf supports.

Shelf standard 12 comprises a U-shaped channel having a slotted front wall 14, rearwardly extending side walls 16 and flanges 18. Flanges 18 are secured to a wall with suitable fasteners 19 so that the shelf standard 12 is vertically oriented to receive shelf supports (not shown). Front wall 14 includes a plurality of slots 20 having a predetermined size and spacing arrangement. Side walls 16 provide a space behind the front wall 14 for accommodating the mounting tabs of the shelf supports.

Adapter 10 comprises a body portion generally indicated at 22, a fixed jaw 24, a movable jaw generally indicated at 26 and a threaded post 28. Body portion 22 and fixed jaw 24 are preferably integrally stamped from a sturdy metal, such as steel. The stamping is then formed into the desired shape as illustrated in the drawing figures. Body portion 22 includes a slotted front wall 30, a rearwardly extending side wall 32 and opposing end walls 34 and 36. Front wall 30 includes a plurality of slots or openings 38 having a predetermined size and spacing arrangement which is different than that of the shelf standard 12 (See FIG. 4). It is pointed out that the front wall 30 can be provided with any desired slot configuration depending on the type of shelf support to be mounted. Fixed jaw 24 extends rearwardly from the upper edge of side wall 32. Fixed jaw 24 is preferably dimensioned so as to fit into the smallest slot opening of known shelf standard manufacturers. Threaded post includes a shaft portion 40 which extends through openings 42,44 respectively formed in end walls 34,36 (See FIG. 4). A first end of the post 28 is provided with head 46 which is engageable with a turning tool, such as a socket wrench (not shown), and the second end of the post 28 is provided with a flange 48 (FIG. 4) to rotatably secure post 28 to body portion 22. The movable jaw 26 includes a body portion 50 with a threaded opening 52 and further includes a jaw element 54 which extends rearwardly and upwardly in linear alignment with the fixed jaw 24. The threaded post 28 extends through the threaded opening 52 and is rotatable for providing collinear movement of the movable jaw element 54 with respect to the fixed jaw 24.

In use, the adapter 10 is releasably mounted on the existing shelf standard 12 to provide a new slot configuration on the existing shelf standard 12. More specifically, the fixed jaw 24 and movable jaw element 54 are received into the existing slots 20 in the shelf standard 12 and the threaded post 28 is rotated using a suitable turning tool to draw the movable jaw element 54 toward the fixed jaw 24 so that the jaws firmly grasp the front wall 14 of the shelf standard 12 (See FIG. 4). When the adapter 10 is mounted on the shelf standard 12, the slotted front wall 30 faces forwardly to present the new slot configuration for receiving a new shelf support generally indicated at 56. Shelf support 56 includes rearwardly extending mounting tabs 58 which are receivable into the slots 38 in the front wall 30 of adapter 10 in the same manner as they would be received in a conventional shelf standard having the appropriate slot configuration.

It can therefore be seen that the instant invention provides an effective adapter 10 for changing the slot configuration of a shelf standard 12 without replacing the shelf standard. The adapter 10 includes a fixed jaw 24 and a movable jaw 26 for releasably attaching the adapter 10 to the existing shelf standard 12. The front wall 30 of the adapter 10 is provided with a desired slot configuration (slots 38), and when the adapter 10 is mounted on the shelf standard 10, the front wall 30 faces forwardly to present the new slot configuration for receiving new shelf supports 56. By using the instant adapters 10, retail merchants no longer need to remove their existing shelf standards 12 each time a new display system is utilized. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. An adapter for a slotted shelf standard comprising:

a body portion including a front wall having a plurality of spaced slots formed therein, said slots being arranged in linear relation along a longitudinal extent of the front wall for accepting tabs of a shelf support, said body portion further including a side wall extending rearwardly from a side edge of said front wall, and still further including opposing first and second end walls;

a fixed jaw member extending rearwardly from said side wall;

a threaded post rotatably mounted within said body, said threaded post having opposing terminal ends which respectively extend through said end walls of said body, one of said terminal ends including a flange, and the other of said terminal ends including an enlarged head portion for engagement with a turning tool; and a movable jaw member threadedly mounted on said threaded post wherein rotation of said threaded post causes sliding linear movement of said movable jaw member with respect to said fixed jaw member, said fixed jaw member and said movable jaw member being received in slots of said shelf standard whereby said slotted front wall of said body portion faces forwardly to receive the tabs of said shelf support, said movable jaw member being slidably movable with respect to said fixed jaw member to releasably grasp said shelf standard.

* * * * *